US006601326B1

(12) United States Patent
Bublitz et al.

(10) Patent No.: US 6,601,326 B1
(45) Date of Patent: Aug. 5, 2003

(54) HUMAN-FIGURE DISPLAY SYSTEM

(76) Inventors: Rebecca J. Bublitz, 11970 N. 70th Ave., Peoria, AZ (US) 85345; Annette L. Terhorst, 11970 N. 70th Ave., Peoria, AZ (US) 85345

( * ) Notice: Subject to any disclaimer, the term of this patent is extended or adjusted under 35 U.S.C. 154(b) by 0 days.

(21) Appl. No.: 09/479,978

(22) Filed: Jan. 10, 2000

(51) Int. Cl.[7] ..... G09F 19/08

(52) U.S. Cl. ..... 40/418; 40/411; 40/419; 40/420; 223/66; 434/396; 446/383

(58) Field of Search ..... 40/411, 418, 419, 40/420; 223/66; 434/267, 396; 446/376, 383

(56) References Cited

U.S. PATENT DOCUMENTS 1,430,811 A * 10/1922 Johnson et al. ..... 40/418
1,579,367 A * 4/1926 Hymer ..... 446/376
1,741,068 A * 12/1929 Newsom
1,833,503 A * 11/1931 Sumner ..... 223/68
2,467,040 A * 4/1949 King ..... 40/418
4,545,514 A * 10/1985 Toy ..... 223/66
4,630,762 A * 12/1986 Stringer ..... 223/66
4,739,911 A * 4/1988 Quinn ..... 223/85
4,918,871 A * 4/1990 Wildmann
D316,876 S * 5/1991 Heseltine ..... D20/31
5,044,960 A * 9/1991 De Porteous ..... 434/274
D375,760 S * 11/1996 Hayden
5,603,177 A * 2/1997 Saunders ..... 40/418
5,947,349 A * 9/1999 Shaalan
6,073,772 A * 6/2000 Forbes et al.
6,257,467 B1 * 7/2001 Chen ..... 223/66

* cited by examiner

*Primary Examiner*—Lynne H. Browne
*Assistant Examiner*—James M. Hewitt
(74) *Attorney, Agent, or Firm*—Martin L. Stoneman

(57) ABSTRACT

A repositionable display system in the shape of a human figure that can be used to communicate information by holding signs or by making simple gestures; or it can be used to support various items such as clothing or accessories. The repositionable display is in the shape of a life-size human form comprising a head, torso, arms, and legs. A two-pin connection forms each shoulder and hip joint, thereby allowing for positioning of the arm and legs in multiple planes. A single-pin connection forms the wrist, elbow, and knee joints. Each of the pin connections are removable, thereby allowing for assembly and disassembly of the repositionable display system. A stand may be provided to maintain the repositionable display system in a substantially upright position. Cedar wood may be used to construct the repositionable display system which assists in repelling insects while emitting a pleasing aroma.

12 Claims, 4 Drawing Sheets

HUMAN-FIGURE DISPLAY SYSTEM

BACKGROUND OF THE INVENTION

1. Field of the Invention

This invention relates to repositionable display systems, especially human figure displays. More specifically, the invention concerns repositionable display systems that are functional for communicating information by holding signs and through simple gestures, and for holding various items for both special occasions and ordinary daily activities. The invention also concerns using a repositionable human figure as a closet accessory and emitting an aroma that is pleasing and also repels insects from clothing closets.

2. Description of the Background and Prior Art

Typically, in the prior art, manikins (also spelled mannequins) are life size, and have been used for displaying clothing that is for sale in retail establishments. See for example, U.S. Pat. No. 1,617,676 to Dobbin, a 1927 patent for a piece goods display form in the shape of a female human body. Dobbin also shows that manikins have previously been held in position by a separate support stand located behind the figure. Manikins having repositionable limbs have also been used for a long time. See for example, U.S. Pat. No. 1,833,503 to Summer, a 1931 patent with pinned joints at some of the natural human joint locations. However, in Summer, and other manikins with pinned joins, only one pinned joint is used at each natural human joint. U.S. Pat. No. 4,545,514 to Toy, a 1985 patent does show an apparatus for displaying garments with biaxial pinned joints at some of the natural human joint locations. However, Toy teaches only a hollow metal frame for displaying clothing, and does not have a solid torso that would provide a meaningful display unclothed. In addition, Toy utilizes hex lock nuts in the joints that require tools for disassembly or adjustment. Toy also does not show a full human figure with a head, hands, or feet. Thus, the prior manikin art performs the functions for which such art is designed, i.e., showing/demonstrating clothing to customers; but such prior art does not fill the need to use a life-size human figure, arousing and attention-getting to most people, to support displays and other non-clothing items and to easily be repositionable in a manner useful for support, display, or arousal.

Dolls have also been around for a long time, and some have repositionable limbs. See for example, U.S. Pat. No. 5,630,745 to Yeh, a 1997 patent showing bendable wires in the joints for repositioning. However, dolls are typically much smaller than life size. If they stand up on their own at all, dolls are typically not sturdy enough to support useful items of some size and/or weight. In addition, the resistance to movement of the joints typically cannot be adjusted, and it is typically difficult to disassemble dolls.

Prior art for hanging clothing, ties, belts, hats, etc. typically includes clothing racks, hat racks, tie racks, and clothing hangers. Although these items can typically be used for more than one purpose, their usefulness is typically tailored to a narrow range of uses, not including the functions of attracting attention (as a life-size human figure might) or of efficient limb repositionability. Various prior art also exists for holding signs. This includes posts, which are most useful where they can be stuck into the ground, and easels, which can be used on hard surfaces such as a floor in a building. Signs can also be fastened to an existing wall. However, the usefulness of this prior technology for holding signs is limited to a small range of purposes.

Various technology exists for repelling insects. This includes moth balls, various chemical insecticides and the like, and cedar wood. Moth balls and insecticides are often effective, but typically do not have a pleasing aroma. In fact, moth balls and most chemical insecticides have objectionable odors. Cedar wood has long been used where clothing is stored, traditionally in the form of cedar chests and cedar closets. Cedar wood emits a pleasant aroma which has the added benefit of repelling certain kinds of insects including moths and silverfish. Cedar wood clothes hangers and hanger inserts have been proposed as an alternative to cedar closets and chests. See U.S. Pat. No. 4,768,686 to Storti, a 1988 patent for an adjustable cedar wood hanger insert. However, prior art has not been found that teaches the features of a cedar wood support/display system in the life-size shape of a human figure.

OBJECTS OF THE INVENTION

A primary object of the present invention is to fulfill the above mentioned needs by the provision of an improved human-figure display system. Specifically, the object and feature of the invention is to provide a versatile display system in the shape of a life-size human figure that can be used for various functional purposes. These functional purposes include attracting attention, holding signs, and holding miscellaneous other items. Another object and feature of the present invention is that it be repositionable for various functions. Another object and feature of the present invention is that it emit a pleasant aroma and repel insects. Further objects and features of the invention are that it be inexpensive, easy to assemble, easy to reposition, portable, and appealing and arousing from a wide range of viewing angles. Other objects of the invention will become apparent with reference to the following invention descriptions.

SUMMARY OF THE INVENTION

According to a preferred embodiment of the present invention, this invention provides a human-figure display system comprising in combination: a human-figure means for forming a life-size shape recognizable as that of a human figure comprising a head, a solid torso, four limbs; and a limb repositioning means for repositioning each such limb into a range of positions, wherein each such limb repositioning means comprises a pin, and a multiaxial means for repositioning each such limb in two planes of rotation. Further, this invention provides such a human-figure display system also comprising a support means for supporting such solid torso of such human-figure means off the floor. In addition, it provides for such human-figure display system further comprising an adjustable means for adjusting the amount of resistance to movement at at least one of such limb repositioning means wherein such adjustable means is hand operable.

Further, this invention provides such a human-figure display system additionally comprising an assembly means for disassembling and reassembling such human-figure means wherein such assembly means comprises a hand-operable fastener. In addition, this invention provides such a human-figure display system wherein such human-figure means essentially comprises flat components. Furthermore, this invention provides such a human-figure display system wherein such human-figure means comprises an aromatic means for emitting a pleasing aroma and for repelling insects; and, further still, wherein such aromatic means comprises aromatic cedar wood.

In addition, in accordance with a preferred embodiment thereof, this invention provides a human-figure display system comprising in combination: a plurality of body parts assembled to form a human figure; and a repositionable pinned joint at each of a plurality of natural human joint locations; wherein such body parts essentially comprise aromatic cedar wood. Further, it provides for such a human-figure display system wherein each such body part is essentially flat, and the human-figure display system wherein such body parts comprise a head, and wherein such head is circular. Even further, this invention provides such a human-figure display system wherein such body parts comprise a pair of feet, and wherein each such foot is shaped in the form of the sole of a human foot. Even further still, this invention provides such a human-figure display system wherein at least one such repositionable pinned joints comprise a biaxial pinned joint.

Also, it provides for such a human-figure display system wherein each such repositionable pinned joint comprises a bolt and a wing nut; and each such biaxial pinned joint comprises two such bolts and two such wing nuts. Further still, this invention provides such a human-figure display system further comprising: a repositionable pinned joint at each of the wrist, elbow, and knee joints; and a biaxial pinned joint at each of the shoulder and hip joints. Yet further, this invention provides such a human-figure display system wherein such body parts further comprise: a head, wherein such head is circular; feet wherein such feet are shaped in the form of the sole of a human foot; hands, wherein such hands are shaped in the form of a human hand; upper arms; lower arms; thighs; and calves. Additionally, it provides such a human-figure display system wherein such human figure is essentially life size.

Yet further still, in accordance with a preferred embodiment thereof, this invention provides for such a human-figure display system comprising in combination: a human form having a head, a solid torso, and four limbs; wherein: such limbs each comprise a plurality of limb parts, such limbs each comprise a repositionable pinned joint connecting such limb parts, such repositionable pinned joints comprise shoulder joints and hip joints, and such shoulder joints and such hip joints each comprise a biaxial pinned joint. In addition, this invention provides such a human-figure display system wherein each such repositionable pinned joint comprises a bolt and a wing nut; and each such biaxial pinned joint comprises two such bolts and two such wing nuts. Yet even further, it provides for such a human-figure display system further comprising wrist joints, elbow joints, and knee joints; wherein each such wrist joint, each such elbow joint, and each such knee joint comprises a such repositionable pinned joint.

Additionally still, this invention provides such a human-figure display system wherein such head, such torso, and such limb parts are essentially flat, and the human-figure display system wherein such head, such torso, and such limb parts essentially comprise wood. Further still, it provides for such a human-figure display system further comprising a metal support stand. Also, this invention provides such a human-figure display system wherein such head is circular and featureless, and wherein such limb parts further comprise: hands, wherein such hands comprise fingers; upper arms; lower arms; shoulders; hips; thighs; and calves, wherein such calves comprise feet.

DETAILED DESCRIPTION OF A PREFERRED EMBODIMENT AND THE BEST MODE OF PRACTICE

Figure 1:
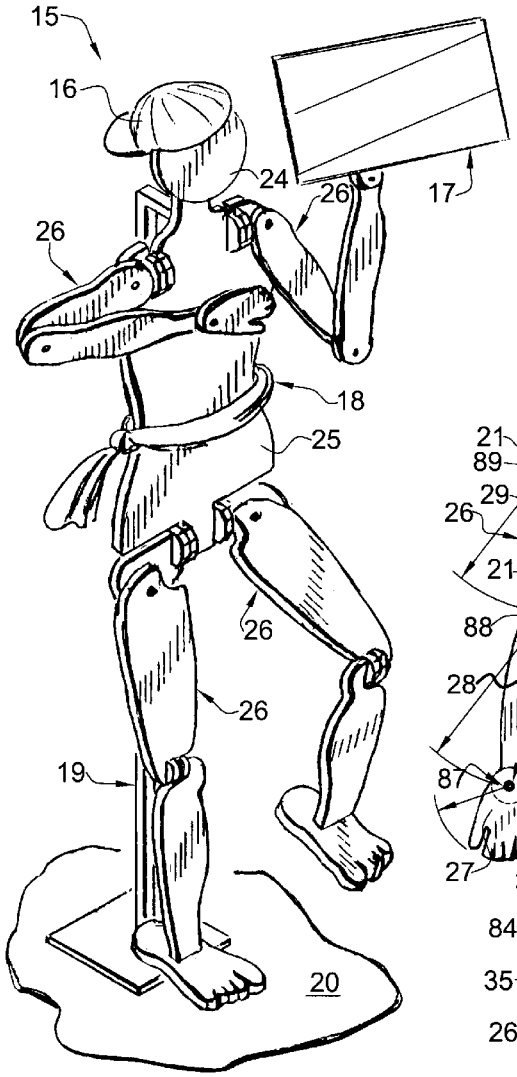
FIG. 1 is a perspective view illustrating a preferred embodiment of the present invention showing a human-figure display system wearing a hat and a scarf, and displaying a sign.

FIG. 1 is a perspective view illustrating a preferred embodiment of the present invention showing a human-figure display system 15 wearing a cap 16 and a scarf 18, and displaying a sign 17. The human-figure display system 15 embodies herein a human-figure means for forming a life-size shape recognizable as that of a human figure comprising: a head 24, a solid torso 25, and four limbs 26. The human-figure display system 15 is preferably supported off of the floor 20 by metal support stand 19. FIG. 1 shows how human-figure display system 15 is repositionable at the locations of some of the natural human joints. FIG. 1 shows how human-figure display system 15 can be used to hold something, such as sign 17. For instance, human-figure display system 15 might be used to hold a sign 17 that indicates directions to a wedding reception or other function. Human-figure display system 15 would usually, in view of its life-size, etc., attract attention of people to the sign 17, and could be used to point the direction to the function. Preferably, accessories such as cap 16 and scarf 18 would be selected for attention-getting and to communicate the decor or the nature of the function. For instance, a cowboy hat could be worn at a western function rather than cap 16. Human-figure display system 15 could also be made to resemble a waiter and used to hold a tray of drinks for guests rather than sign 17. Thus, the waiter look would communicate the purpose that the human-figure display system 15 was being used.

Figure 2:
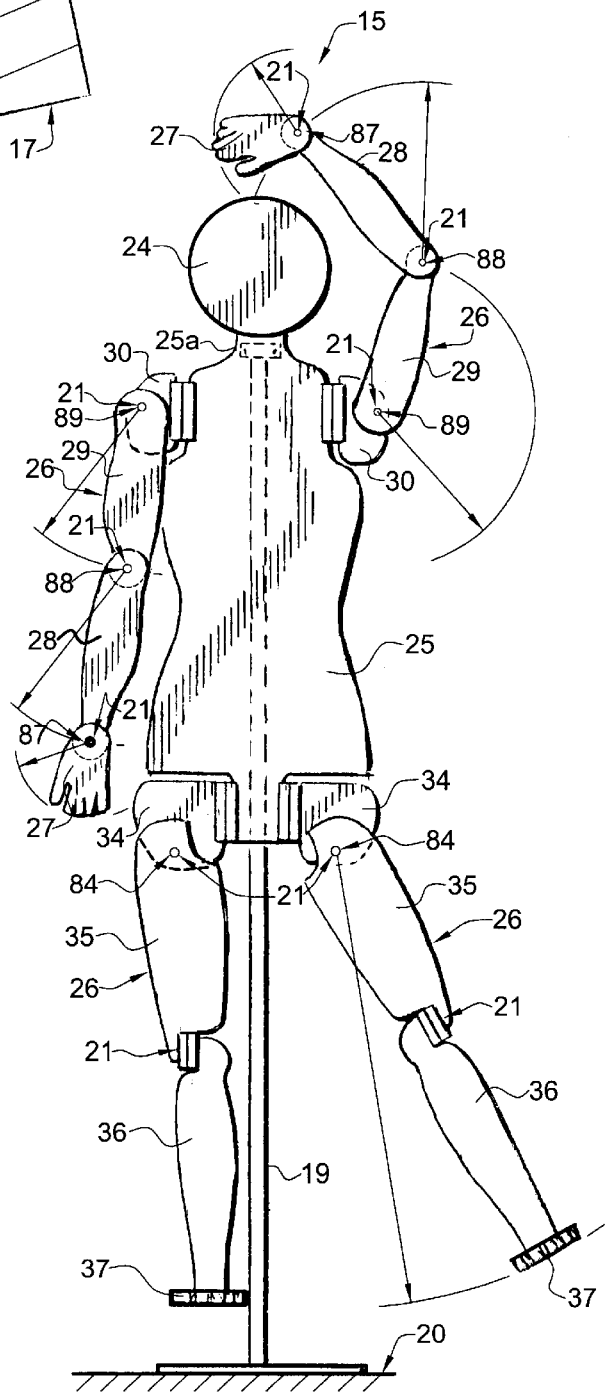
FIG. 2 is a front view of the illustrated preferred embodiment of the present invention depicting part of the range of motion of some of the repositionable pinned joints.

FIG. 2 is a front view of the illustrated preferred embodiment of the present invention depicting part of the range of motion of some of the repositionable pinned joints 21. Human-figure display system 15 preferably comprises the following body parts: head 24, torso 25, two hands 27, two lower arms 28, two upper arms 29, two shoulders 30, two hips 34, two thighs 35, two calves 36, and two (a pair of) feet 37. As shown, head 24 is preferably circular and featureless, which is simple and inexpensive to manufacture. As can be best seen in FIG. 1, (as embodied herein) each foot 37 is preferably shaped in the form of the sole of a human foot. In addition, each hand 27 preferably has fingers and is shaped in the form of a human hand.

Human-figure display system 15 is preferably life size (such human figure is essentially life size—the size of an adult), about six feet tall. Human-figure display system 15 preferably has repositionable pinned joints 21 in the plane (first plane) depicted by the arcs shown in FIG. 2 at the wrist joint 87, elbow joint 88, shoulder joint 89, and hip joint 84. Although these joints are repositionable, the clamping force in the repositionable pinned joints 21 can be adjusted to secure them in any position within the range of movement. The present invention preferably also comprises support stand 19 which is supported off the floor 20.

Figure 3:
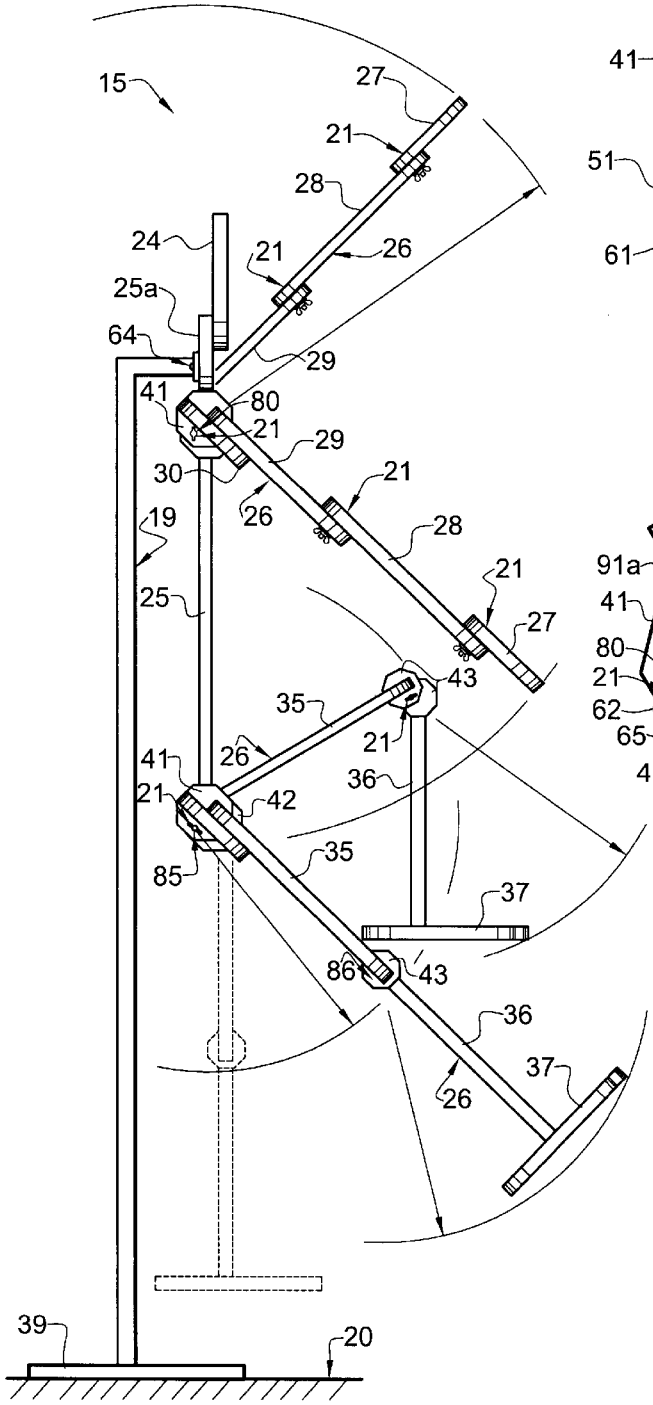
FIG. 3 is a side view of the illustrated preferred embodiment of the present invention depicting part of the range of motion of some of the repositionable pinned joints and showing the support stand.

FIG. 3 is a side view of the illustrated preferred embodiment of the present invention depicting part of the range of motion of some of the repositionable pinned joints 21 and showing the support stand 19. Human-figure display system 15 preferably has repositionable pinned joints 21 in the plane (second plane) depicted by the arcs in FIG. 3 at the shoulder joint 80, hip joint 85, and knee joint 86. The wrist joint 87, elbow joint 88, shoulder joint 89, and hip joint 84 (shown in FIG. 2) and shoulder joint 80, hip joint 85, and knee joint 86 (shown in FIG. 3) embody herein a limb repositioning means for repositioning each such limb 26 into a range of positions.

In addition, the wrist joint 87, elbow joint 88, shoulder joint 89, and hip joint 84 (shown in FIG. 2) and shoulder joint 80, hip joint 85, and knee joint 86 (shown in FIG. 3) embody herein some of the natural human joint locations. Also shown and numbered are joint members 41, 42, and 43 (preferably octagon-shaped) which in the preferred embodiment are components of the repositionable pinned joints 21 at the shoulder joint 80, hip joint 85, and knee joint 86. As can be seen from FIG. 2 and FIG. 3, the shoulders 30 and hips 34 preferably each contain two repositionable pinned joints 21 (shoulder joints 80 and 89 and hip joints 84 and 85) which provide freedom in two planes (first and second planes) of rotation. These joints with two degrees of freedom are herein called biaxial joints. Joints with two or more degrees of freedom are herein called multiaxial joints. It can be said that shoulder joints 80 and 89 and hip joints 84 and 85 embody herein a multiaxial means for repositioning each such limb 26 in two or more planes of rotation.

FIG. 3 also clearly shows that the body parts from which human-figure display system 15 is formed are preferably essentially flat. These body parts are preferably made out of wood, and are preferably cut from one-inch (nominal) thick boards (actual thickness is about ¾-inches). The body parts are typically cut out with a jig saw, saber saw, or band saw, and the parts are then sanded smooth and painted if desired. Utilizing flat body parts (embodying herein flat components) significantly reduces the cost of human-figure display system 15 when compared with three dimensional body parts. However, the biaxial joints (shoulder joints 80 and 89 and hip joints 84 and 85) produce a three dimensional effect. The wood can be painted, stained and varnished, or left unfinished. FIGS. 1 through 7 depict painted body parts, while FIG. 8 depicts wood that is unfinished (unfinished wood surface 79 as shown in FIG. 8).

FIG. 3 also shows support stand 19 which preferably supports human-figure display system 15 from behind. Support stand 19 preferably rests on the floor 20, and preferably attaches to human-figure display system 15 at the neck portion 25*a* of torso. Support stand 19 is preferably made of steel tubing preferably welded to a base plate 39. Support stand 19 is preferably painted to prevent corrosion and provide a pleasing appearance. A neutral color is preferable so that the viewer's eye will land on the human-figure display system 15 rather than on support stand 19. FIG. 2 and FIG. 3 show human-figure display system 15 held a few inches above the floor 20. However, human-figure display system 15 could also be supported so that the feet 37 are in contact with the floor 20. Support stand 19 embodies herein a support means for supporting the solid torso 25 of the human-figure off the floor 20.

Figure 4:
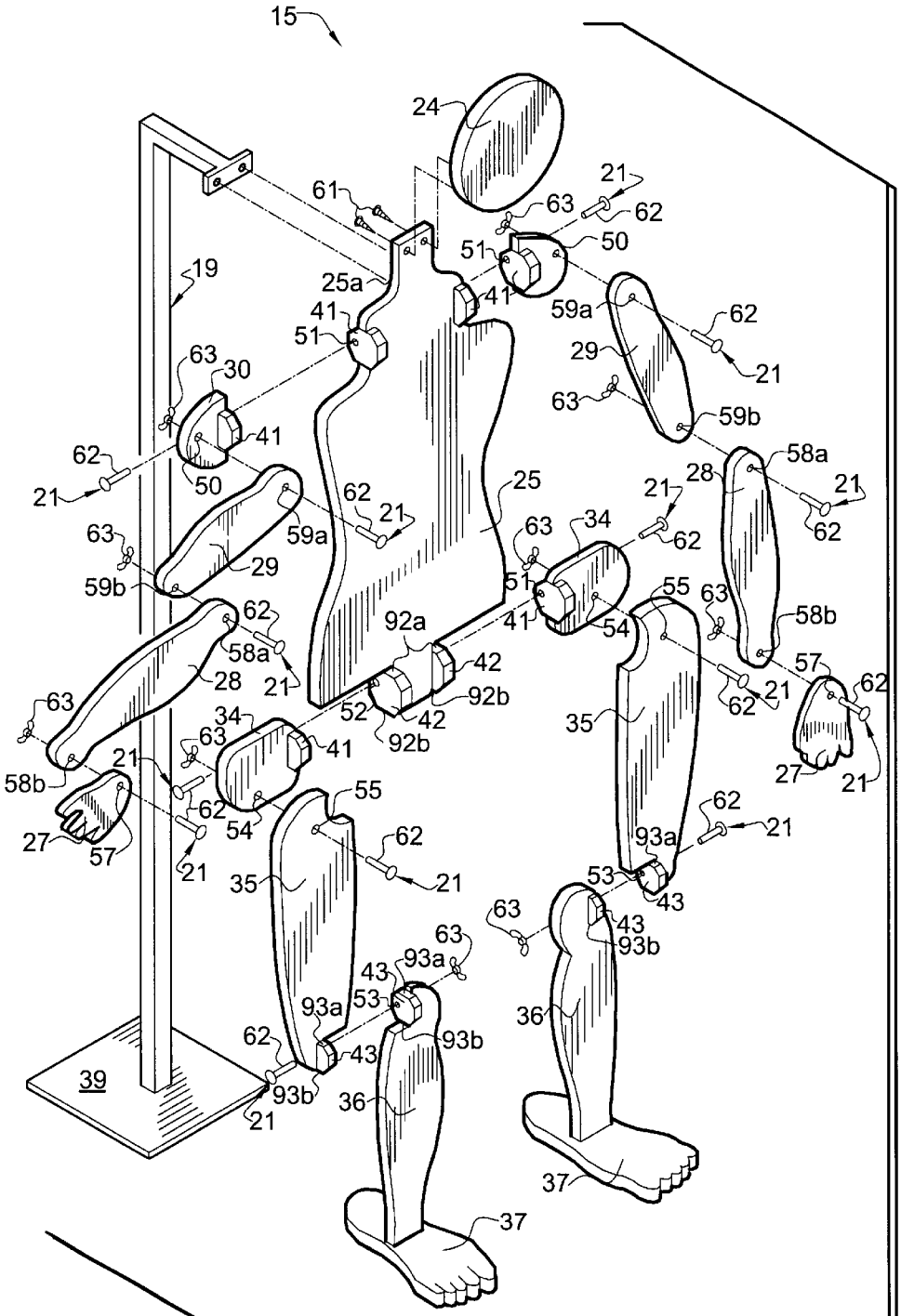
FIG. 4 is an exploded perspective view of the illustrated preferred embodiment of the present invention showing the parts of the human-figure display system and how they fit together.

FIG. 4 is an exploded perspective view of the illustrated preferred embodiment of the present invention showing the parts of the human-figure display system 15 and how they fit together. In other words, FIG. 4 shows a plurality of body parts assembled to form a human figure. The body parts shown include: head 24, torso 25 (complete with neck 25*a*), two hands 27, two lower arms 28, two upper arms 29, two shoulders 30, two hips 34, two thighs 35, two calves 36, and two feet 37. Hands 27, lower arms 28, upper arms 29, shoulders 30, hips 34, thighs 35, calves 36, and feet 37 embody herein limb parts. Also shown are six joint members 41 at the shoulder joints 80 and hip joints 85, two joint members 42 at hip joints 85, and four joint members 43 at knee joints 86.

In FIG. 4, joint members 41, 42, and 43 are shown where they are preferably permanently attached to their respective body parts (torso 25, shoulder 30, hip 34, thigh 35, and calf 36 as shown) preferably with two wood screws 61 at each location, and preferably also with wood glue (not shown). Head 24 is also attached to torso 25 preferably with two wood screws 61 as shown, and feet 37 are attached to calves 36, preferably with two wood screws 61 (not shown) for each foot 37, and wood glue. In the preferred embodiment, a total of 30 wood screws 61 are required (only two are shown in FIG. 4). Wood screws 61 are preferably 1 ¼ inch long Philips head dry wall screws.

FIG. 4 also shows bolts 62 and wing nuts 63. Bolts 62 embody herein pins and, along with the body parts that bolts 62 pass through, form pinned joints which are repositionable (repositionable pinned joints 21) and hand operable. In the preferred embodiment illustrated, a total of 14 bolts 62 and 14 wing nuts 63 are utilized. In the preferred embodiment, bolts 62 pass through holes 51 in joint member 41, holes 50 in shoulders 30, holes 59*a* in upper arms 29, holes 59*b* in upper arms 29, holes 58*a* in lower arms 28, holes 58*b* in lower arms 28, holes 57 in hands 27, holes 52 in joint member 42, holes 54 in hips 34, holes 55 in thighs 35, and holes 53 in joint member 43 as shown. All of the holes (50, 51, 52, 53, 54, 55, 57, 58*a*, 58*b*, 59*a*, and 59*b*) are preferably ¼ inch in diameter, and extend all the way through the respective part.

The human-figure display system 15 can be easily disassembled into the parts shown in FIG. 4. Tools are not usually needed except for a Philips head screw driver to detach head 24 from neck 25*a* of torso 25, and to detach support stand 19 from neck 25*a* of torso 25. The bolts 62 and wing nuts 63 embody herein hand-operable fasteners. In other words, bolts 62 and wing nuts 63 embody herein an assembly means for disassembling and reassembling such human-figure wherein such means comprises a hand-operable fastener. Each combination of a bolt 62 and a nut 63, and the two body parts through which they pass, embody herein a repositionable pinned joint 21.

Figure 5:
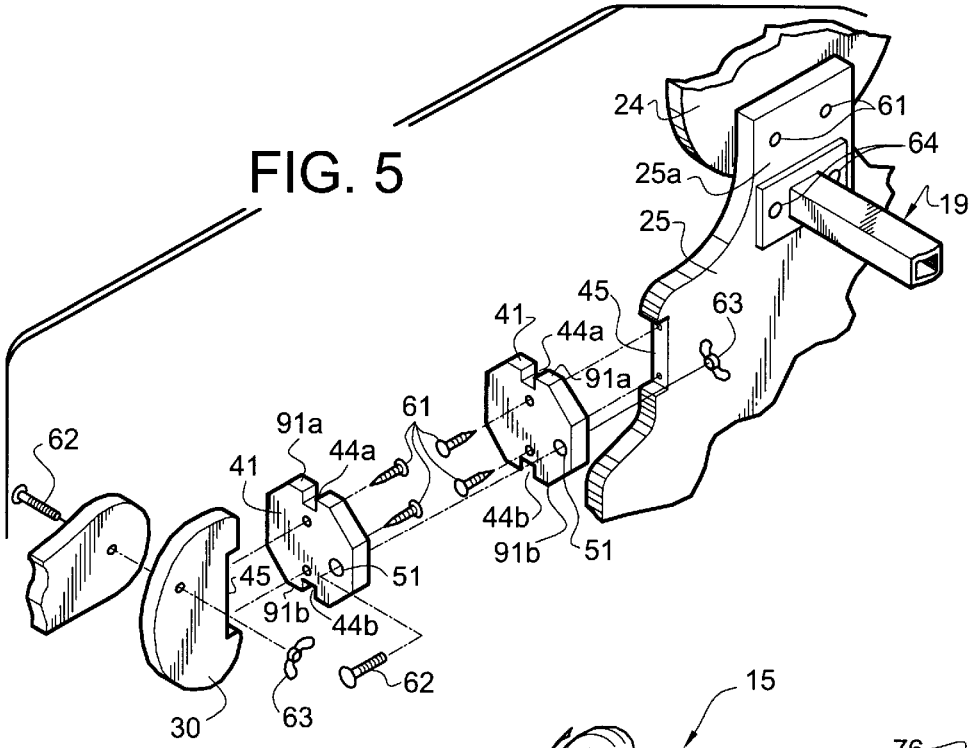
FIG. 5 is a partial exploded perspective view of the illustrated preferred embodiment of the present invention showing details of the shoulder joint, how the support stand attaches, and how the associated parts fit together.

FIG. 5 is a partial exploded perspective view of the illustrated preferred embodiment of the present invention showing details of the shoulder joints 80 and 89, how the support stand 19 attaches, and how the associated parts fit together. Head 24 attaches to neck 25*a* on torso 25 preferably with two screws 61 as shown. Just below where head 24 attaches to neck 25*a*, support stand 19 preferably attaches to neck 25*a* on torso 25 with two wood screws 64. Wood screws 64 are preferably about ¾ inch long.

Joint member 41 attaches to torso 25 as shown, preferably with two wood screws 61 and wood glue. Joint member 41 is preferably notched as shown at the top 91*a* with notch 44*a*, and at the bottom 91*b* with notch 44*b*, and fits into recess 45 which is preferably about ⅜-inch deep. The glue (not shown) is preferably applied to the entire surface inside recess 45 before installing joint member 41. Excess glue is preferably wiped off immediately after installing and tightening screws 61.

Another joint member 41 is preferably attached to shoulder 30 in the same manner, including two wood screws 61, wood glue, notches 44*a* at the top 91*a* and 44*b* at the bottom 91*b*, and recess 45. Another joint member 41 is preferably attached to hip 34 (see FIG. 4) in the same manner, including two wood screws 61, wood glue, notches 44*a* at the top 91*a* and 44*b* at the bottom 91*b*, and recess 45. Joint members 43 (see FIG. 4) are preferably attached to thighs 35 and calves 36 in the same manner (not shown), including two wood screws 61, wood glue, notches 44*a* at the top 93*a* and 44*b* at the bottom 93*b*, and recess 45. Joint members 42 (see FIG. 4) are preferably attached to torso 25 in the same manner (not shown), except that no notch 44*b* is required at the bottom 92*b* of joint member 42 due to lack of an adjacent recess 45 support structure in torso 25. However, the attachment of joint member 42 (not shown) preferably does include two wood screws 61, wood glue, notch 44*a* at the top 92*a* only, and recess 45.

Joint members 41 and 42 are preferably about 3 ⅝ inches across (from flat to flat), and joint members 43 are preferably about 2 ½ inches across. Holes 51 in joint member 41 are preferably on the back side of human-figure display system 15, as shown in FIG. 5. Similarly, holes 52 in joint member 42 and holes 53 in joint member 43 are preferably also on the back side of human-figure display system 15 (see FIG. 4). The two joint members 41 shown in FIG. 5 are preferably connected with bolt 62 and wing nut 63 forming shoulder joint 80 (shown in FIG. 3). The formation of the hip joint 85, and knee joint 86 are accomplished in a substantially similar manner as shoulder joint 80 (see FIG. 3).

Figure 6:
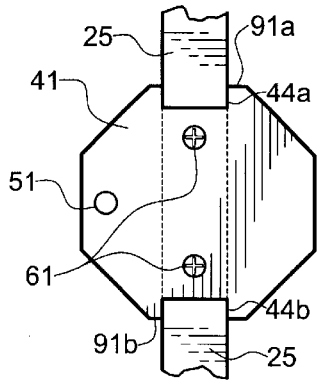
FIG. 6 is a partial side view of the illustrated preferred embodiment of the present invention showing a detail of the shoulder joint without the arm attached.

FIG.6 is a partial side view of the illustrated preferred embodiment of the present invention showing a detail of the shoulder joint 80 without the arm (shoulder 30, upper arm 29, etc.) attached. FIG. 6 shows how screws 61 preferably attach joint member 41 to torso 25. It can be seen in FIG. 6 how notches 44*a* and 44*b* in joint member 41 preferably fit into the recess 45 in torso 25 to provide a secure attachment. Although not shown in FIG. 6, the attachment of joint member 41 to shoulder 30, joint member 41 to hip 34, joint member 43 to thigh 35, and joint member 43 to calf 36 are all similar (see FIG. 4). The attachment of joint member 42 to torso 25 is similar except that there is no notch 44*b* on the bottom 92*b* of joint member 42 (see FIG. 4).

Figure 7:
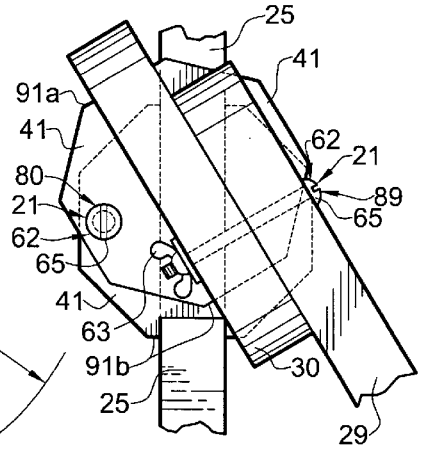
FIG. 7 is a partial side view of the illustrated preferred embodiment of the present invention showing a detail of the shoulder joint with the arm attached and positioned at an angle.
Figure 8:
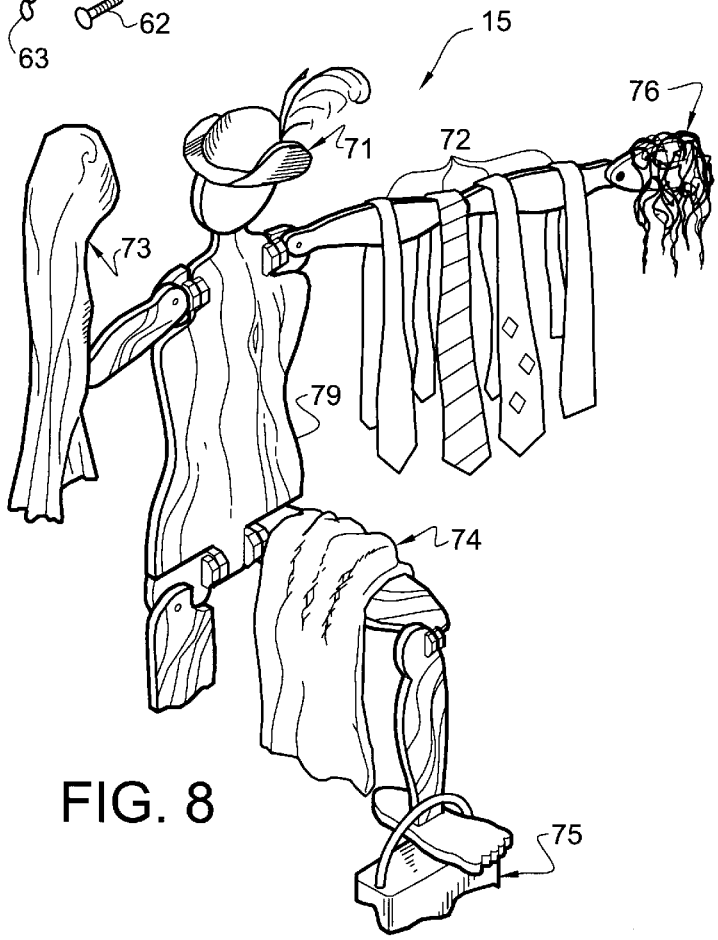
FIG. 8 is a partial perspective view illustrating a preferred embodiment of the present invention with the optional unfinished wood surface as it might be used in a closet supporting a hat, and holding ties, a couple of garments, a wig, and a bag.

FIG. 7 is a partial side view of the illustrated preferred embodiment of the present invention showing a detail of the shoulder joint 80 with the arm (shoulder 30 and upper arm 29) attached and positioned at an angle. FIG. 7 shows the best view of bolts 62, which are preferably ¼-inch UNC stove bolts (slot heads) and are preferably about 2-inches long. Wing nuts 63 can typically be tightened and loosened by hand without the use of tools. Joints like these (80, 84, 85, 87, 88, and 89) that can be tightened and loosened by hand without tools are herein said to be hand operable. The limbs 26 of the human-figure display system 15 can be repositioned by loosening wing nut 63 slightly (if necessary) and manually articulating the repositionable pinned joint 21 (shoulder joints 80 or 89 as shown in FIG. 7). With respect to shoulder joint 89, upon loosening wing nut 63, the upper arm 29 is free to rotate about the bolt 62 which forms the shoulder joint 89.

Likewise, with respect to shoulder joint 80, loosening of wing nut 63 (as shown best in FIG. 5) allows for free rotation of the assembly comprising the joint member 41, the shoulder 30, and the upper arm 29 (with attached lower arm 28 and hand 27) about bolt 62 which forms shoulder joint 80. Once in the desired position, the wing nut 63, which was loosened so as to obtain the desired configuration is tightened by hand. If bolt 62 is completely loose, then it may be necessary to hold the head 65 of bolt 62 with the other hand. If necessary, a slot head screw driver can be used on head 65 of bolt 62, or a pair of pliers can be used on wing nut 63; however, the use of such tools is normally not necessary.

Once wing nut 63 is tightened, the clamping force of bolt 62 and wing nut 63 presses the two parts together (for instance shoulder 30 and upper arm 29 as shown in FIG. 7 for shoulder joint 89) creating enough frictional force to hold the two parts (for instance shoulder 30 and upper arm 29 as shown in FIG. 7) from sliding against each other. In other words, bolts 62, and wing nuts 63 embody herein an adjustable means for adjusting the amount of resistance to movement of the limbs 26 wherein such means is hand-operable. Articulation of the hip joints 84 and 85, knee joints 86, wrist joints 87, and elbow joints 88 is accomplished in a substantially similar manner as the herein before illustrated and described shoulder joints 80 and 89, and will not be discussed in any greater detail herein.

FIG. 8 is a partial perspective view illustrating a preferred embodiment of the present invention as it might be used in a large walk-in closet. The a human-figure display system 15 is shown wearing (holding) a hat 71, holding ties 72, garment 73, garment 74, wig 76, and bag 75. The optional unfinished wood surface 79 is shown. In a closet, human-figure display system 15 would preferably be made of unfinished cedar wood so that it will emit a pleasant odor and repel moths and silverfish. Cedar wood embodies herein an aromatic means for emitting a pleasing aroma and for repelling insects. Human-figure display system 15 could be positioned in an infinite number of positions depending on the needs and desires of the users. It can be used to hold many other items different from those shown, such as, for example, belts, bola ties, and towels.

Although applicant has described applicant's preferred embodiments of this invention, it will be understood that the broadest scope of this invention included such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A human-figure display system comprising in combination:

a) A human-figure means for forming a life-size shape recognizable as that of a human figure comprising: a head, a solid torso, four limbs;

b) wherein said human-figure means comprises primarily flat components; and c) a limb repositioning means for repositioning each said limb into a range of positions, comprising:
   i) at least one pin, and
   ii) a multiaxial means for repositioning each said limb in at least two planes of rotation;

d) wherein said multiaxial means comprises at least one substantially flat component having a flat end portion transverse to said substantially flat component.

2. The human-figure display system according to claim 1 further comprising a support means for supporting said solid torso of said human-figure means off the floor.

3. The human-figure display system according to claim 1 wherein at least one of said at least one pin further comprises an adjustable means for adjusting the amount of resistance to movement at at least one of said limb repositioning means wherein said adjustable means is hand operable.

4. The human-figure display system according to claim 1 wherein at least one of said at least one pin further comprises an assembly means for disassembling and reassembling said human-figure means wherein said assembly means is hand operable.

5. The human-figure display system according to claim 1 wherein said human-figure means comprises an aromatic means for emitting a pleasing aroma and for repelling insects.

6. The human-figure display system according to claim 5 wherein said aromatic means comprises aromatic cedar wood.

7. The human-figure display system according to claim 1 wherein said at least one pin penetrates each said limb perpendicularly to and through said at least one substantially flat component.

8. The human-figure display system according to claim 7 wherein said human figure means essentially comprise aromatic cedar wood.

9. A human-figure display system comprising in combination:

a) a human form having a head, a solid torso, and four limbs;

b) wherein:
   i) said limbs each comprise a plurality of limb parts,
   ii) said limbs each comprise a repositionable pinned joint connecting said limb parts,
   iii) said repositionable pinned joints comprise shoulder joints and hip joints, and
   iv) said shoulder joints and said hip joints each comprise a biaxial pinned joint;
   v) each said repositionable pinned joint comprises
      (1) a bolt and
      (2) a wing nut; and
   vi) each said biaxial pinned joint comprises
      (1) two said bolts and
      (2) two said wing nuts,
      (3) at least one substantially flat component having a flat end portion transverse to said substantially flat component.

10. The human-figure display system according to claim 9 further comprising:

(a) wrist joints, elbow joints, and knee joints;

(b) wherein each said wrist joint, each said elbow joint, and each said knee joint comprises a said repositionable pinned joint.

11. The human-figure display system according to claim 9 wherein a) each said limb part comprises at least one substantially flat component, and a) each said bolt penetrates at least one said limb part perpendicularly to and through said at least one substantially flat component of said at least one said limb part.

12. The human-figure display system according to claim 11 wherein said limb parts essentially comprise aromatic cedar wood.

* * * * *